United States Patent [19]

Williamson, Jr.

[11] Patent Number: 4,766,960

[45] Date of Patent: Aug. 30, 1988

[54] STANDING AND INJECTION VALVE

[75] Inventor: Jimmie R. Williamson, Jr., Carrollton, Tex.

[73] Assignee: Otis Engineering Corporation, Dallas, Tex.

[21] Appl. No.: 77,634

[22] Filed: Jul. 24, 1987

Related U.S. Application Data

[63] Continuation-in-part of Ser. No. 849,125, Apr. 7, 1986, Pat. No. 4,691,777.

[51] Int. Cl.[4] ..... E21B 34/10

[52] U.S. Cl. ..... 166/321; 137/493.7; 166/325; 166/332

[58] Field of Search ..... 166/319, 321, 320, 325, 166/327, 328, 332, 318, 317; 137/493.7

[56] References Cited

U.S. PATENT DOCUMENTS

| | | | |
|---|---|---|---|
| 3,066,735 | 12/1962 | Zingg | 166/318 X |
| 3,524,503 | 8/1970 | Baker | 166/289 |
| 3,713,490 | 1/1973 | Watson | 166/318 |
| 3,915,228 | 10/1975 | Giebeler | 166/321 |
| 4,352,366 | 10/1982 | Fisher, Jr. | 166/321 X |
| 4,374,543 | 2/1983 | Richardson | 166/319 X |
| 4,441,558 | 4/1984 | Welch et al. | 166/321 X |
| 4,494,608 | 1/1985 | Williams et al. | 166/317 |
| 4,664,195 | 5/1987 | Deaton | 166/323 |
| 4,691,777 | 9/1987 | Williamson, Jr. | 166/332 X |
| 4,691,778 | 9/1987 | Pyne | 166/321 X |

*Primary Examiner*—Hoang C. Dang

*Attorney, Agent, or Firm*—Roland O. Cox

[57] ABSTRACT

Standing valves which may be operated as injection valves without removal from a well conduit are disclosed. All disclosed valves permit upward production flow and prevent downward injection flow. One valve form utilizes a ball valve to control production and injection flow, and two valve forms utilize annular valves to control flow. In one annular valve form, production and injection flow is controlled by the annular valve. In the other annular valve form, production flow is controlled by check valve means and injection flow is controlled by the annular valve. These standing valves are opened for injection flow by increasing valve interior fluid pressure to a predetermined pressure to open control check valves permitting the pressured fluid to flow to pressure responsive operators in the valve housings. Opening pressure of the control check valves is variable. When injection pressure is reduced sufficiently, the operators are returned to injection valve closed position by a bias, and operating fluid returns from the operators through other check valves which permit flow from the operators back to the interior of the standing valves.

11 Claims, 7 Drawing Sheets

STANDING AND INJECTION VALVE

This is application is a continuation-in-part of my copending application for letters patent, Ser. No. 849,125, filed Apr. 7, 1986, now U.S. Pat. No. 4,691,777.

BACKGROUND OF THE INVENTION

1. Technical Field. This invention is related to valves and particularly to a valve useful as a standing valve or an injection valve to control flow in a well flow conductor.

2. Background Art. Many standing valves have been developed and used in well flow conductors to permit production flow to the surface when the well reservoir contains sufficient pressure, and close to protect the reservoir from damage caused by pressured flow down the conduit into the reservoir. As it is frequently later desirable to pump chemicals or water for injection into the reservoir, down through the standing valve, standing valves have been developed having a flow passage which may be permanently opened to permit pumped flow down and provide for unrestricted two way flow through the valve. An example of a VELOCITY OPERATED STANDING VALVE is shown in U.S. Pat. No. 4,352,366 to Ernest P. Fisher, Jr. A flow path around the normally closed ball valve in the Fisher standing valve may be opened for downward flow of injected fluids or upward flow of produced fluids. U.S. Pat. No. 4,441,558 to Wlliam R. Welch and Thomas J. Heard covers another form of standing valve which may be opened for upward and downward flow. U.S. Pat. No. 4,502,542 discloses a well system which utilizes a standing valve, through which a flow path may be opened to permit two-way flow.

DISCLOSURE OF INVENTION

A ball valve form and an annular valve form of the standing injection valve of this invention may be used in a well flow conduit or well tool string, to operate repeatedly as a usually bias closed standing valve, opened by higher pressure below or outside the standing injection valve which overcomes the closing bias and opens the valve to permit flow upward in the well conduit. On sufficient reduction in pressure, the bias returns the valve to closed position preventing downward flow through the valve. One annular valve form utilizes a conventional ball type standing valve which is not biased closed.

Unlike the prior art valves, the ball valve and annular valve types of the standing injection valve of this invention may also be operated repeatedly as usually bias closed injection valves, opened for downward injection flow by a predetermined higher pressure from above the valve. There are flow passages in the valve housing walls communicating the interior of the valve with a pressure responsive operator for opening the valve for injection flow. One flow passage has a check valve with a predetermined opening pressure which may be varied. This check valve permits flow from the standing injection valve interior to the pressure responsive operator, opening the valve for injection. The other wall flow passages have check valves which permit flow from the operator to the valve interior when injection pressure is reduced sufficiently and the bias returns the operator and valve to the closed position. The ball type standing injection valve can be retrieved from the well and converted to operate as an injection only valve. Both the ball type and the annular type standing injection valves will operate as standing valves when higher pressures are outside or below the valves or operate as injection valves when higher pressures are above, without removal from the well conduit.

An object of this invention is to provide valves useful as standing valves or injection valves.

An object of this invention is to provide standing injection valves which when used as injection valves will close on sufficient reduction of injection pressure and prevent upward flow through.

Another object of this invention is to provide standing injection valves having a variable predetermined injection opening pressure.

Also an object of this invention is to provide standing injection valves which will close rapidly on sufficient reduction of injection flow rate.

Another object of this invention is to provide a ball type standing injection valve which operates as a standing valve when the ball valve slides in the valve housing and operates as an injection only valve when the ball valve is prevented from sliding.

Also an object of this invention is to provide standing injection valves which may include a choke controlling injected volume flow or volume flow through the valve.

BEST MODE FOR CARRYING OUT THE INVENTION

Figure 1:
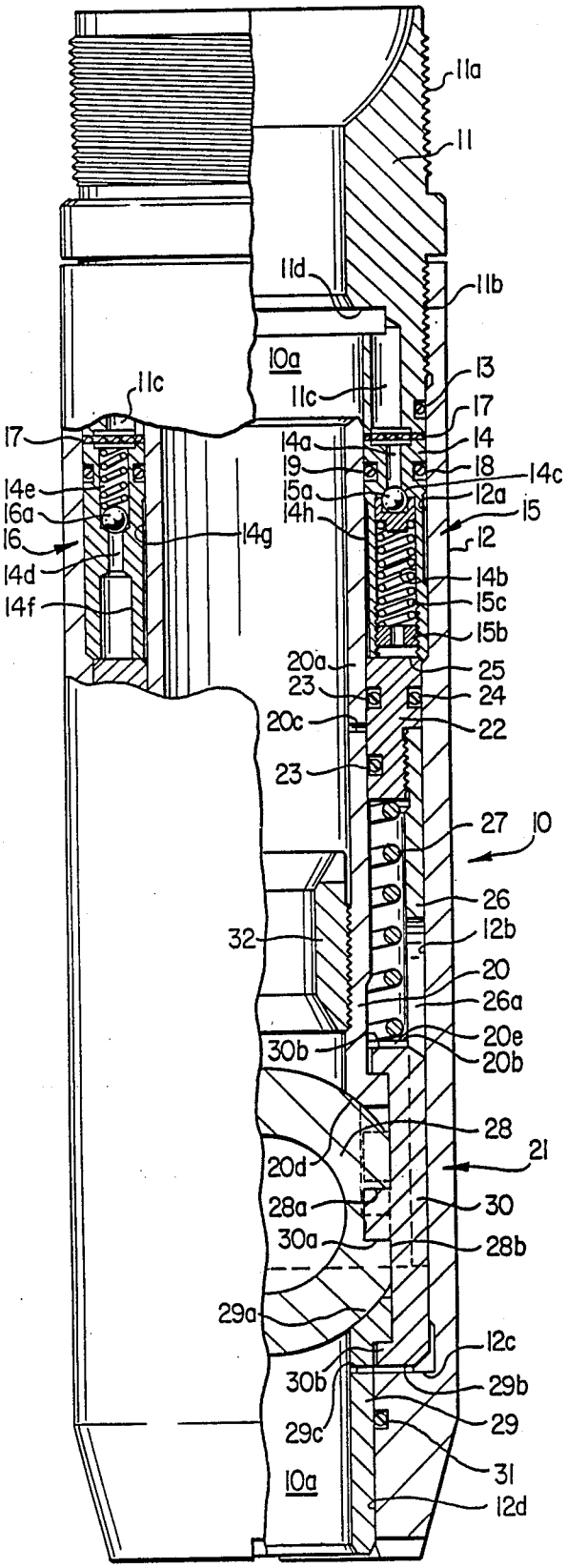
FIG. 1 is a partially sectioned elevation view drawing of the ball valve form of the standing injection valve of this invention in closed position.

FIGS. 1, 2, 3 and 4 show one preferred form 10 of the standing injection valve of this invention which utilizes a ball type valve. As shown in FIG. 1, the valve 10 has a flow passage 10*a* and a connector 11 which includes an appropriate thread 11*a* for connecting the valve to a tool string or in a well conduit. The connector has another thread 11*b* connecting it to a housing 12. Resilient seal 13 seals the connector to the housing. The housing has bore 12*a* in which is installed control valve housing 14. This housing has a flow passage hole 14*a* which has a bore counter 14*b*, and a control inlet check valve 15 is installed in the bore. The check valve ball 15*a* sealingly engages seating surface 14*c* in valve housing 14, and adjusting screw 15*b* is turned to compress spring 15*c* more or less. The control valve housing has at least one more flow passage hole 14*d* which has a counterbore 14*e* and counterbore 14*f*. A control outlet check valve 16 is installed in bore 14*e*. Check valve ball 16*a* sealingly engages seating surface 14*g* in control valve housing 14.

Connector 11 has wall flow passages 11*c* which communicate between flow passage 10*a* and passages 14*a* and bore 14*e*. This connector also has a shoulder 11*d*. A filter 17 is trapped between connector 11 and control valve housing 14. Resilient seal 18 seals the housing 14 in housing bore 12*a*, and resilient seal 19 seals the housing around an extension 20*a* of the upper seat 20 for ball valve 21. This extension is slidably mounted in control valve housing longitudinal bore 14*h*.

Figure 5:
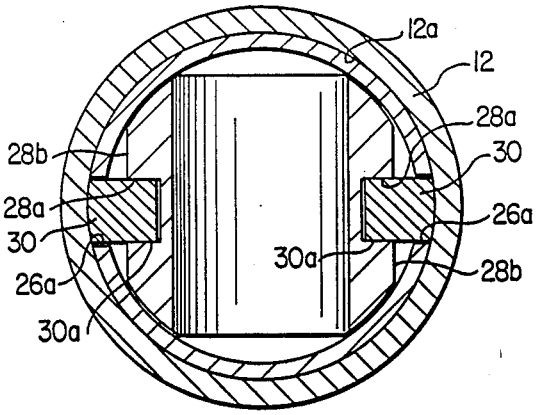
FIG. 5 is a cross section drawing of the closed valve of FIG. 3, viewed as indicated along line 5—5 in FIG. 3.
Figure 6:
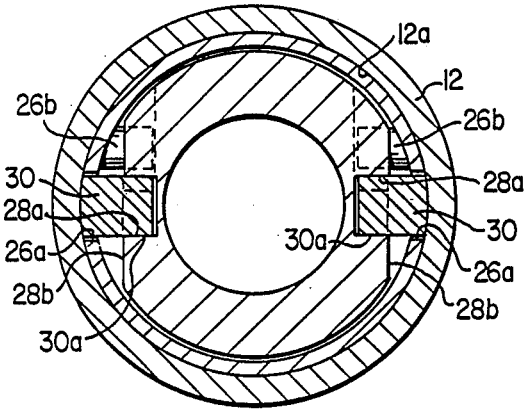
FIG. 6 is a cross section drawing of the open valve of FIG. 4, viewed as indicated along line 6—6 of FIG. 4.
Figure 9:
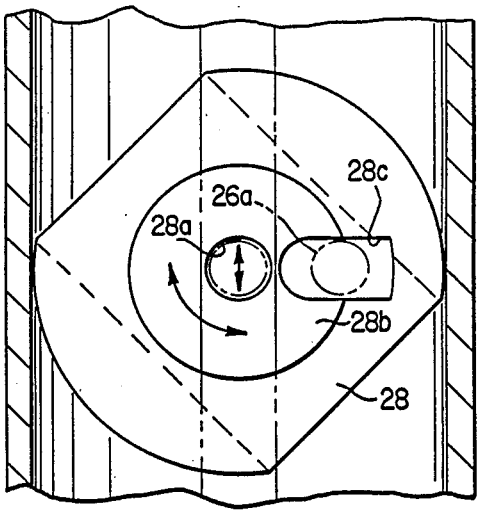
FIG. 9 is an enlarged drawing showing the valve ball moveable between open and closed positions by the arm pins.
Figure 7:
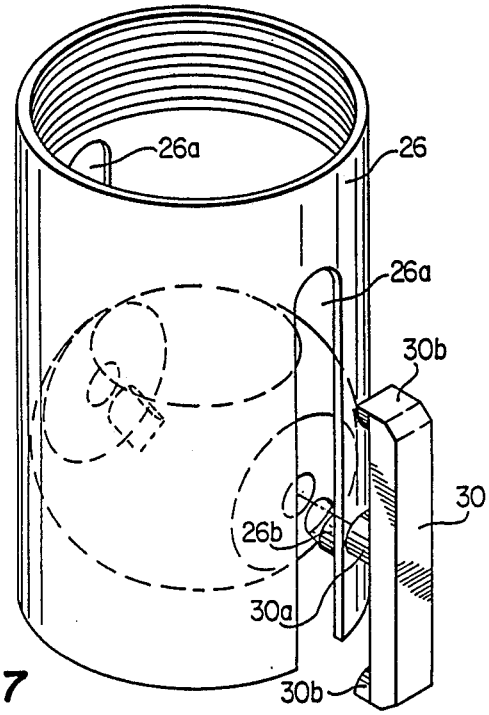
FIG. 7 is an exploded view drawing showing the elements which operate the ball between open and closed positions.

Housing 12 has another bore 12*b* in which an annular piston 22 is slidably mounted around upper seat extension 20*a*. This piston is sealed around the seat extension with resilient seals 23 and sealed in bore 12*b* with seal 24 to form a variable volume pressure chamber 25 with control valve housing 14, housing 12 and seat extension 20*a*. Threadedly connected to piston 22 is a sleeve 26 having opposite slots 26*a* which are better shown in FIG. 7. The upper seat 20 has a shoulder 20*b* on which spring 27 bears and pushes piston 22 up to contact the lower end of control valve housing 14. Upper seat extension 20 is provided with a flow port 20*c* which is positioned between seals 23 when piston 22 is up. A valve ball 28 is held in sealing engagement with sealing surface 20*d* on upper seat 20 and sealing surface 29*a* on lower seat 29 by arms 30 which are slidably disposed in sleeve slots 26*a* (see also FIGS. 5 and 6). Each arm 30 has a pin 30*a* which is rotatably engaged in a hole 28*a* in ball flat surface 28*b*. Each arm also has projections 30*b* which are engaged in upper seat slots 20*e* and in lower seat slots 29*b*.

The valve ball 28 is also provided with an open ended slot 28*c* in each flat surface 28*b*, see FIGS. 5, 6, 7, 8 and 9. The sleeve 26 has opposite pins 26*b* which may be seen in FIGS. 6 and 7. Each pin is slidably positioned by sleeve 26 in a valve ball flat slot 28*c*. FIG. 1 shows the body 12 provided with a stop shoulder 12*c* and another bore 12*d*. The lower seat 29, which also has a flow port 29*c*, is slidably mounted and sealed in housing bore 12*d* by resilient seal 31. An appropriate connection may be included on the lower end of housing 12 for connection of the standing injection valve into a well flow conductor or well tool string. A choke 32 restricting flow in flow passage 10*a* has been installed in upper seat extension 20*a*.

Figure 2:
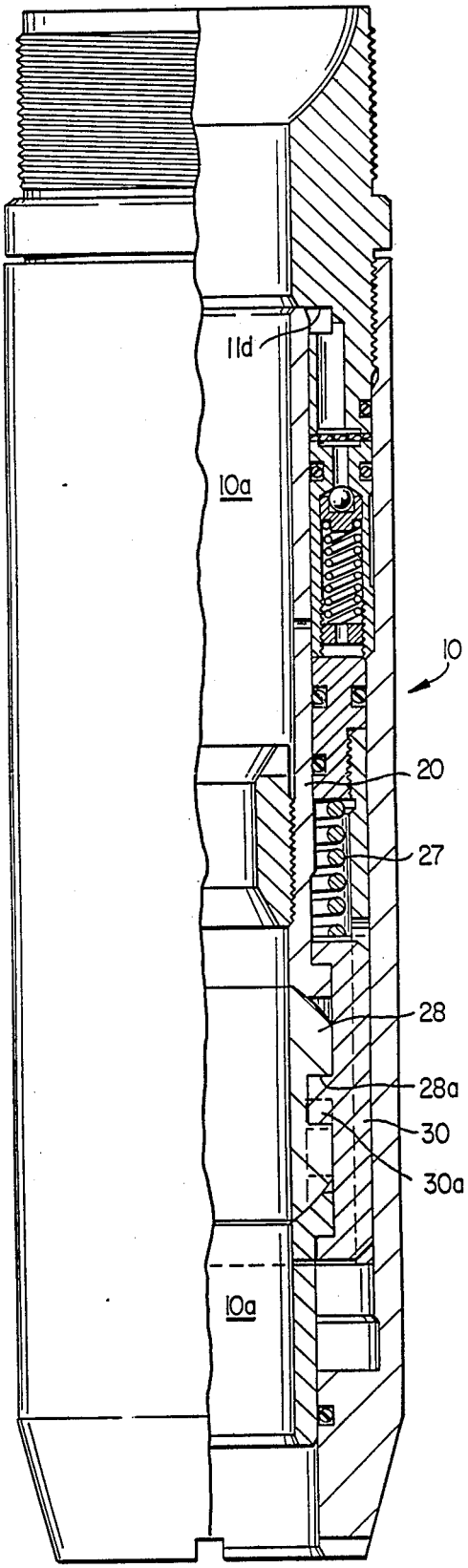
FIG. 2 is a partially sectioned elevation view drawing of the standing injection valve of FIG. 1 open for production flow.

To use the biased to closed position ball valve form of the standing injection valve shown in FIG. 1 as a standing valve or an injection valve, adjusting screw 15*b* should be turned to set the designed opening pressure of inlet control valve 15 and ball valve 21 for injection, and valve 10 should be installed at the proper level in the well flow conduit. When higher pressure acting upward from below on the area closed by ball 28 on upper seat 20 and sealed by seal 23 on the outside of upper seat extension 20*a* produces sufficient force to move upper seat 20 up and compress spring 27, arms 30 are pulled up by the upper seat. Upward movement of piston 22 and attached sleeve 26 with pins 26*b* is prevented by control valve housing 14. 0n increase in the pressure below the ball and upward force, the lower seat moves upwardly and compresses the spring further, while arms 30 and pins 30*a* in ball holes 28*a* have rotated (see FIG. 9) valve ball 28 around sleeve pins 26*b* to open position as shown in FIG. 2, permitting flow upward through flow passage 10*a*. When flow and pressure from below decrease sufficiently, compressed spring 27 extends and slides the valve 21 downwardly, while the valve ball 28 is rotated (see FIG. 9) around sleeve pins 26*b* to return the ball valve to closed position as shown in FIG. 1. Higher pressure not exceeding the opening pressure of inlet control valve 15 above the closed valve in flow passage 10*a* acting downwardly on the area closed by ball 28 on seat 29 and sealed by seal 23 on the outside of extension 20*a* produces a down force which cannot move the upper seat down and rotate the ball to open position because down movement of the upper seat is prevented. The seat cannot push the valve ball and arm pins 30 down, rotating the ball about sleeve pin 26*a*, as the lower end of arm 30 contacts housing shoulder 12*c*.

Figure 3:
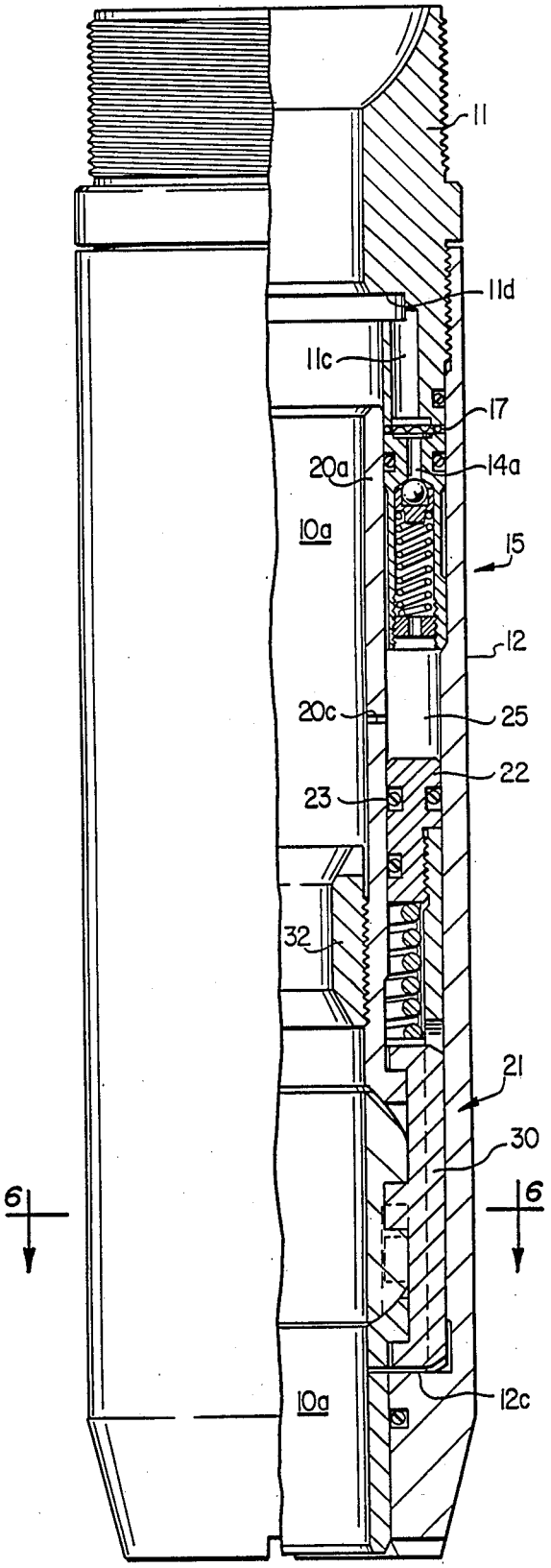
FIG. 3 is a partially sectioned elevation view drawing of the ball valve form of the invention standing injection valve open for injection flow.

To operate the ball valve form of the standing injection valve of this invention as an injection valve, pressure is increased in flow passage 10*a* above the closed ball valve 21 to the predetermine opening pressure of valve 15 which acts into flow passages 11*c*, through filter 17, into flow passages 14*a* and 14*e*, opening check valve 15 and closing check valve 16. Flow now occurs through open check valve 15 into chamber 25 and moves piston 22 and sleeve 26 with pins 26*a* downwardly, compressing spring 27. As down movement of arms 30 is prevented by body shoulder 12*c*, downward movement of pins 26*a* in ball slots 28*c* rotate the valve ball around arm pins 30*a* to open position (see FIG. 8). When upper seal 23 on piston 22 moves below hole 20*c* in upper seat extension 20*a*, pressure in flow passage 10*a* is communicated through hole 20*c* into chamber 25 to act on piston 22. Increased pressure in passage 10*a* and injection flow through valve 21 will move the valve 21 to open position as shown in FIG. 3. If desired, choke 32 may be sized to limit injected flow volume or production flow volume into the well conduit.

Figure 8:
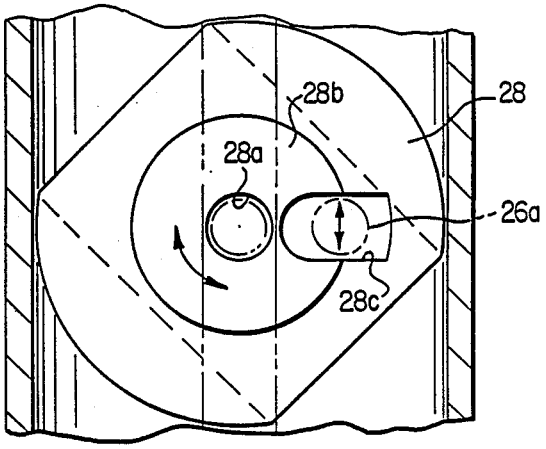
FIG. 8 is an enlarged drawing showing the valve ball moveable between open and closed positions by the sleeve pins.

On reduction of injected flow through valve 21 and pressure in flow passage 10*a*, spring 27 extends moving the piston, sleeve and pins 26*a* upward, exhausting fluid from chamber 25 through port 20*c* into flow passage 10*a* and rotating the valve ball around arm pins 30*a* back towards closed position (see FIG. 8). When upper piston seal 23 is moved above hole 20*c*, fluid exhausting from chamber 25 closes check valve 15 and acts through counterbore 14*f* and hole 14*d* to open check valve 16 permitting flow exhausting from chamber 25 to flow through counterbore 14*e*, filter 17 and flow passage 11*c* back into flow passage 10*a*. To provide a larger flow area for exhaust fluid from chamber 25, additional outlet check valves 16 may be installed in additional counterbores 14*e* in control valve housing 14. When piston 22 upward travel is stopped by the lower end of control valve housing 14, valve 21 has returned to closed position as shown in FIG. 1. Standing injection valve 10 will continue to operate repeatedly as a standing valve when production pressure below increases to open valve 21 or operate repeatedly as an injection valve when pressure above valve 21 in the well conduit is increased to the opening pressure of inlet control valve 15 and valve 21.

Figure 4:
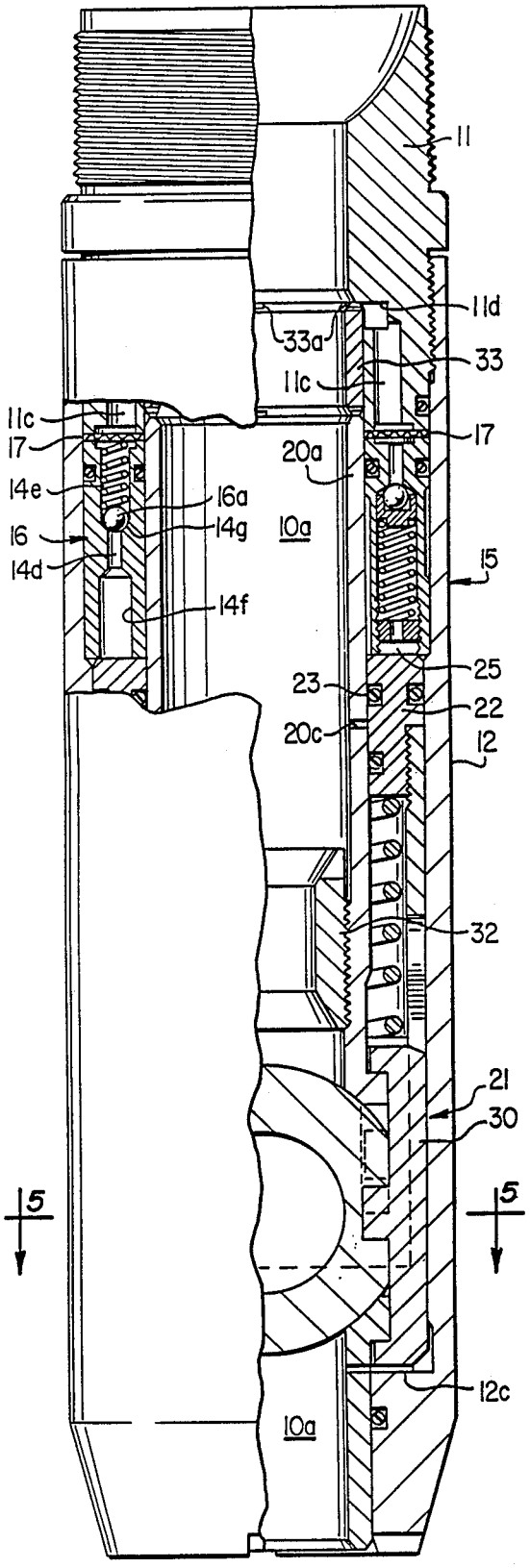
FIG. 4 is a partially sectioned elevation view drawing of the standing injection valve of this invention operable as an injection valve only.

The ball valve form of the standing injection valve of this invention may be operated as an injection valve only, by adding before installation in the well conduit, a spacer 33 shown in FIG. 4. This spacer has slots 33*a* and is installed between the top end of seat extension 20*a* and shoulder 11*d* in connector 11. After setting the opening pressure of inlet check valve 15 and installing valve 10 in the well conduit, production pressure from below closed valve 21 in flow passage 10*a* cannot move valve ball 28 and the upper seat upwardly to open the valve for upward flow because upward movement of the upper seat is prevented by spacer 33 and valve 21 cannot slide upwardly in housing 12 to open position. The valve 15 now cannot operate as a standing valve, but may be opened for injection flow as previously described by increasing pressure in flow passage 10*a* above closed ball valve 21 to the predetermined opening pressure of valve 15 which acts through slots 33*a* into flow passages 11*c*.

Figure 10:
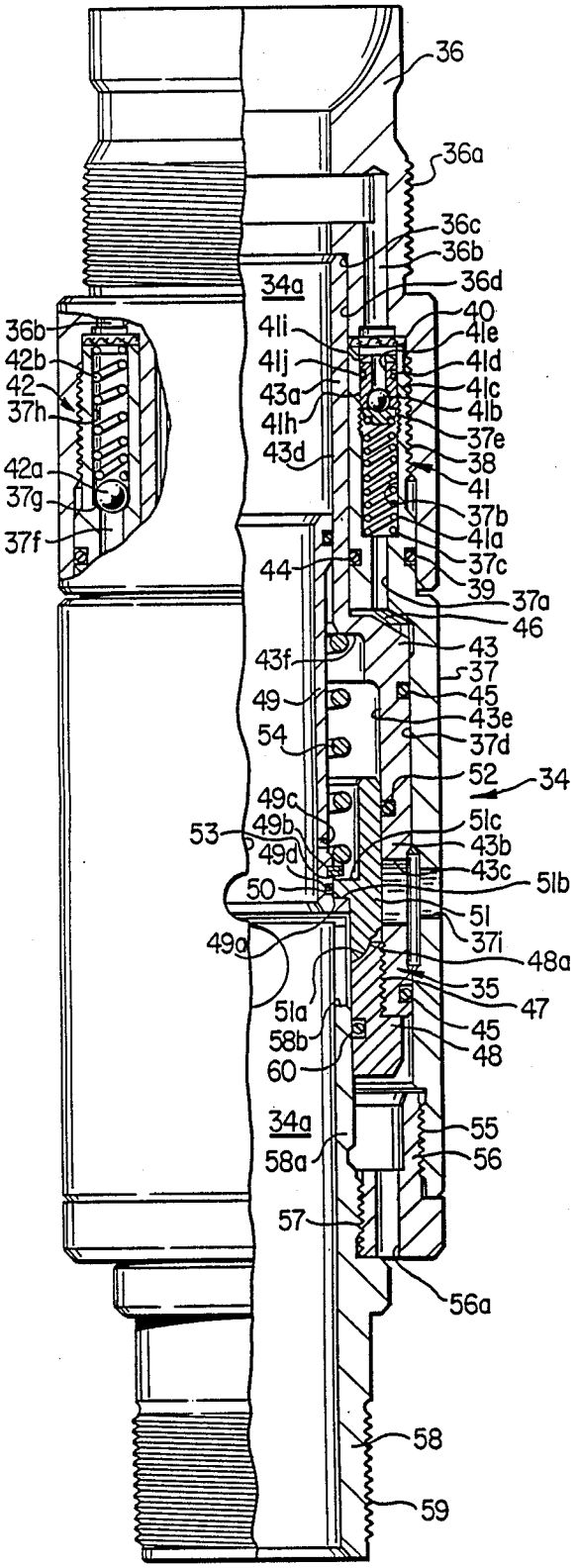
FIG. 10 is a partially sectioned elevation view drawing of one annular valve form of the standing injection valve of this invention in closed position.
Figure 11:
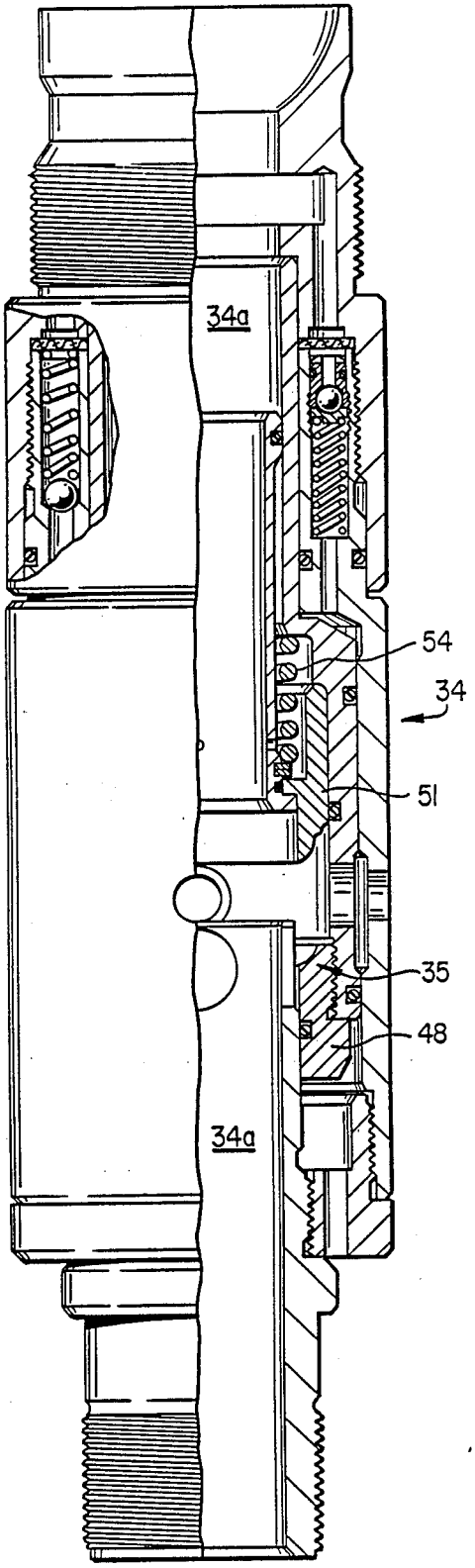
FIG. 11 is a drawing showing the standing injection valve of FIG. 10 open for production flow.
Figure 12:
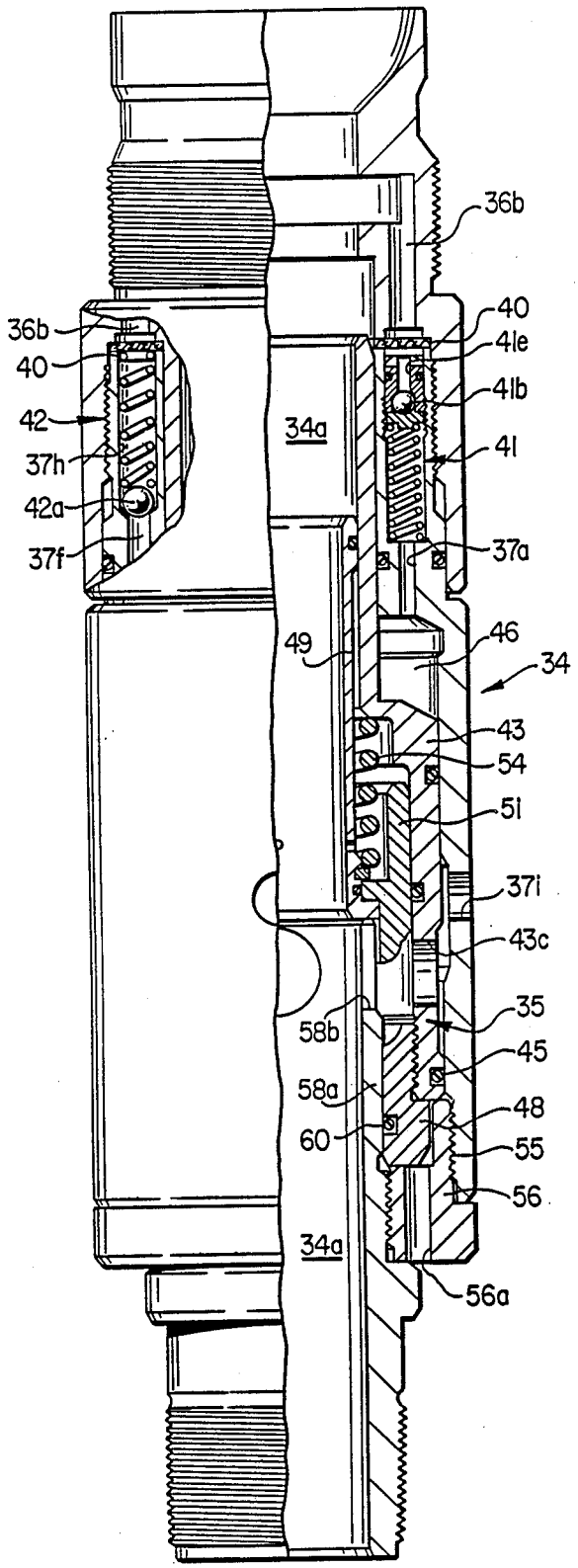
FIG. 12 is a drawing showing the valve of FIG. 10 in open position for injection flow.

FIGS. 10, 11 and 12 show another form 34 of the standing injection valve of this invention, which utilizes a sleeve valve 35 to control flow between interior flow passage 34*a* and regions exterior of this valve. Valve 34, as shown in FIG. 10, has a connector 36 having an appropriate thread 36*a* for connecting the valve in a well flow conduit or in a well tool string. The connector also has a number of flow passages 36*b* in communication with passage 34*a*, a shoulder 36*c* and a bore 36*d*. The connector is connected and sealed to housing 37 with thread 38 and resilient seal 39. A filter 40 is trapped between the housing and connector. The housing is provided with a flow passage 37*a* having a counterbore 37*b* which is in communication with passage 36*b*, a shoulder 37*c* and a bore 37*d*. Installed in counterbore 37*b* is an inlet control check valve 41. The check valve includes a spring 41*a*, bearing on shoulder 37*c* and sealingly engaging a valve ball 41*b* with a seal surface 41*c* on seat 41*d*. The seat has a flow passage 41*e* which communicates with passage 36*b* through filter 40. The seat also has threads 41*h* engaged in counterbore threads 37*e* and a slot 41*i* and is sealed in bore 37*b* with resilient seal 41*j*.

The housing is provided with at least one more flow passage 37*f* which has a sealing surface 37*g* and a counterbore 37*h* in communication with passage 36*b* through filter 40. Installed in counterbore 37*h* is a check valve 42. The check valve includes a valve ball 42*a* and a spring 42*b*.

Slidably mounted in housing bore 37*d* is an annular piston 43 having an upper extension 43*a* extending into connector bore 36*d* and a lower extension 43*b*. The upper extension has a bore 43*d*, the lower extension has a bore 43*e*, and the piston has an internal shoulder 43*f*. The upper extension is sealed in bore 36*d* with resilient seal 44 and sealed in bore 37*d* with resilient seal 45 and forms variable volume pressure chamber 46.

Housing 37 is provided with at least one port 37*i* and piston extension 43*b* also has at least one port 43*c*. The lower piston extension is sealed in housing bore 37*d* below port 43*c* with another resilient seal 45. Attached to the lower piston extension with threads 47 is an annular seat 48 having a sealing surface 48*a*.

Slidably mounted in piston bore 43*d* is a valve mandrel 49 which has a shoulder 49*a*, a groove 49*b*, a vent port 49*c* and another groove 49*d*. An annular valve 51 is slidably mounted and sealed in piston bore 43*e* with resilient seal 52 and sealed to valve mandrel 49 with resilient seal 50. This valve has a sealing surface 51*a*, which is sealingly engageable with sealing surface 48*a* and has internal shoulders 51*b* and 51*c*. A retaining ring 53 has been installed in groove 49*b*, trapping shoulders 51*b* and 51*c* between the ring and shoulder 49*a* and rotatably connecting mandrel 49 to valve 51. A spring 54 is positioned around mandrel 49 between the retaining ring and piston shoulder 43*f*.

Connected to the lower end of housing 37 with thread 55 is a bushing 56 which is provided with a flow passage 56*a*. Connected in the bushing with threads 57 is a lower connector 58 which is provided with threads 59 (if required), an extension 58*a* and at least one port 58*b*. The annular seat 48 is slidably mounted around and sealed to extension 58*a* by resilient seal 60.

The sleeve valve form of the standing injection valve of this invention, as shown in FIG. 10, may be operated in a well conduit as a standing valve or an injection valve. Before installation in a well, the opening pressure of control check valve 41 should be set to the desired opening pressure of sleeve valve 35 for injection flow. The opening pressure of valve 41 may be varied and determined by turning seat 41*e*. The biased closed valve is then connected or installed in a well flow conduit with the producing formation in communication with sleeve valve 35 through ports 37*i* and 43*c* and valve flow passage 34*a* in communication with the inside of the well conduit. When higher pressure exterior of the valve acts through port 37*i* up on seal 45 above port 37*i* and down on seal 45 below port 37*i*, annular piston 43 is not moved in either direction as the areas sealed are equal. When pressure exterior of the valve acting through port 43*c* and upwardly on the annular area sealed by resilient seals 50 and 52 develops sufficient force to overcome the downward force of spring 54, annular valve 51 and connected mandrel 49 move upwardly from annular seat 48, opening valve 35 for production flow from exterior of the valve through port 37*i* and port 43*c* into flow passage 34*a* and up the well conduit. Increased flow volume will further compress spring 54 and move valve 51 upwardly to open position as shown in FIG. 11. On sufficient reduction of flow and pressure exterior of the valve, spring 54 extends, moving valve 51 downwardly to sealingly engage seat 48 as shown in FIG. 10. Now if pressure in passage 34*a* becomes higher than pressure exterior of the valve, the higher pressure acts through vent port 49*c* and downwardly on the area sealed by resilient seals 50 and 52, sealing valve 51 tighter on seat 48. Resilient seal 60 prevents flow between seat 48 and extension 58*a* and no flow can occur from flow passage 34*a* through valve 51 and ports 43*c* and 37*i* to the exterior of valve 34.

When it is desirable to operate the standing injection valve 34 as an injection valve, pressure is increased in flow passage 34*a*. This pressure acts through flow passages 36*b*, filter 40 and into seat flow passage 41*e* on valve ball 41*b* and into counterbore 37*h* on valve ball 42*a* closing check valve 42. When pressure in passage 34*a* acting on valve ball 41*b* reaches the predetermined opening pressure of control check valve 41, valve 41 opens and flow occurs through flow passage 37*a* into chamber 46, moving piston 43 and seat 48 downwardly compressing spring 54 and exhausting fluids below lower resilient seal 45 and resilient seal 60 through passage 56*a* to exterior of valve 34. Increased pressure in valve passage 34*a* will move piston 43 and seat 48 down to the open position of valve 35 as shown in FIG. 12. Annular valve member 51 and connected mandrel 49 cannot move down as the lower end of the mandrel is stopped on the upper end of connector extension 58*a* and injected flow may occur from passage 34*a* through connector ports 58*b*, open valve 35, ports 43*c* and 37*i* to the valve 34 exterior.

On reduction of injected flow and pressure in passage 34*a*, spring 54 extends, moving piston 43 and seat 48 upwardly, closing control check valve 41 and opening check valve 42, permitting fluid to flow from chamber 46 back into passage 34*a*. On continued upward movement of the piston, seat 48 is sealingly reengaged with valve member 51, closing valve 35 to flow, as shown in FIG. 10. Valve 34 will continue to operate as a standing valve in response to sufficiently higher exterior production pressure or as an injection valve if pressure in the well conduit and flow passage 34*a* is increased sufficiently to open the sleeve valve. The inside diameter of valve mandrel 49 may be decreased as required to choke and control injected flow volume or production flow into the well conduit.

Figure 14:
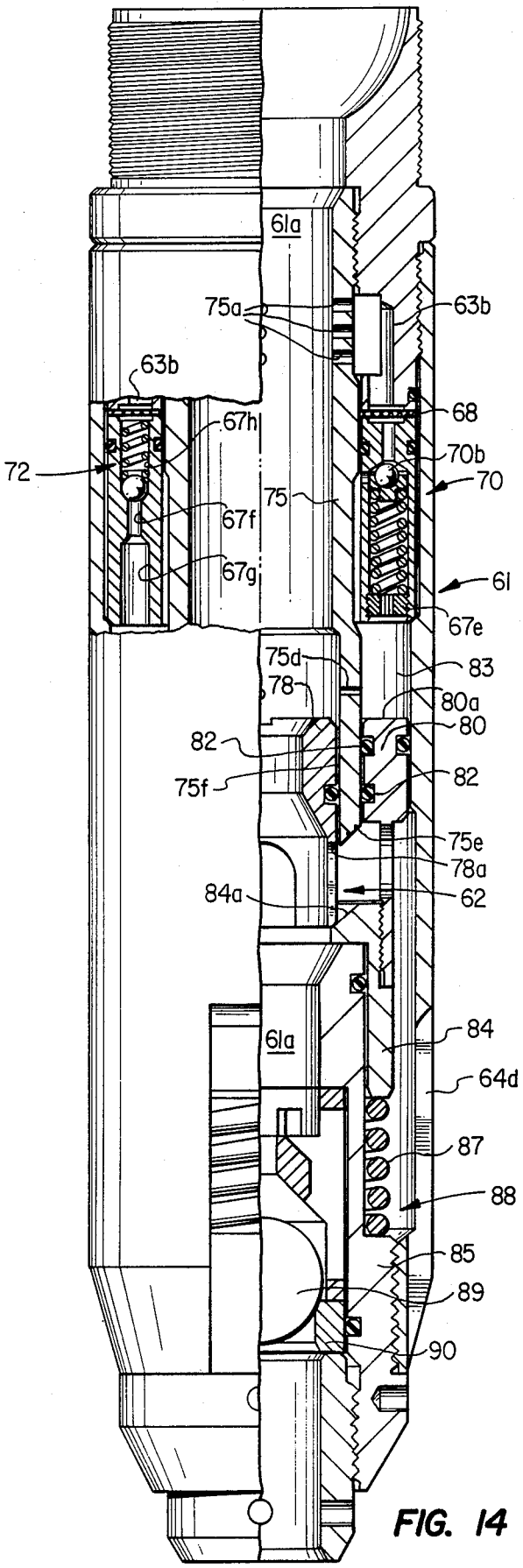
FIG. 14 is a drawing showing the standing injection valve of FIG. 13 open for injection flow.
Figure 13:
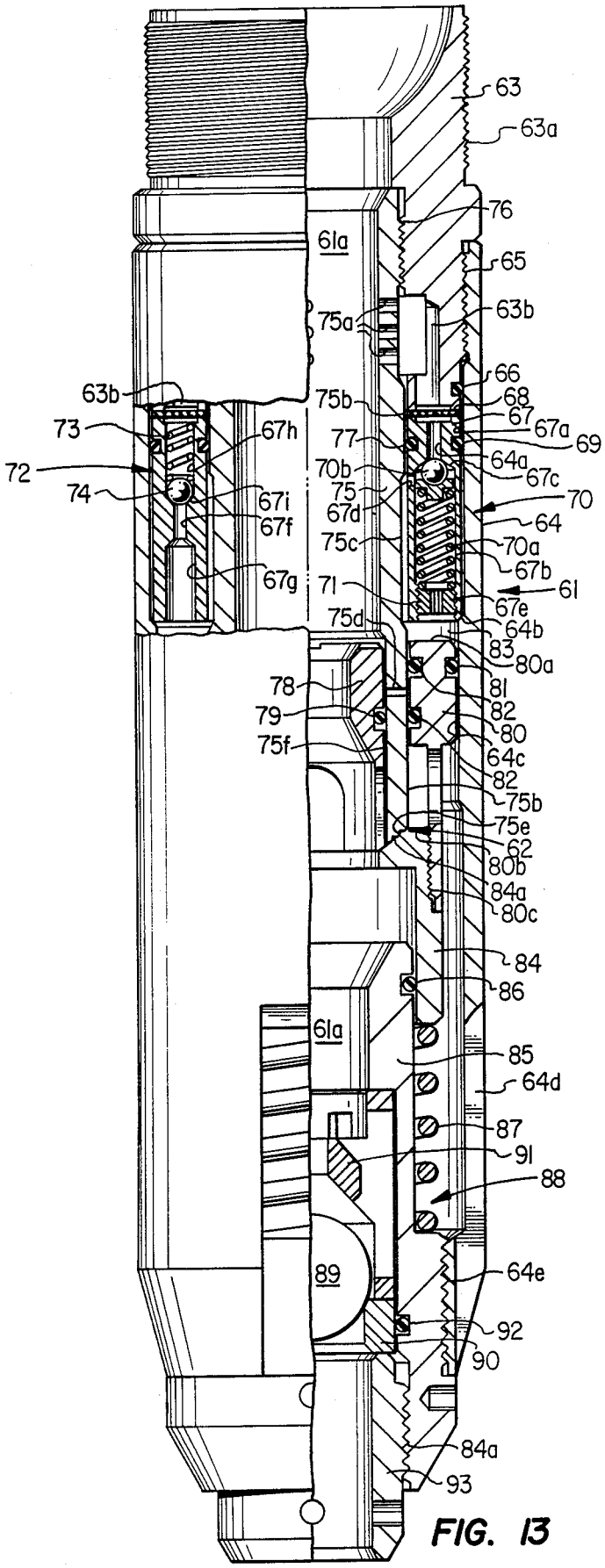
FIG. 13 is a partially sectioned elevation view drawing of another annular valve form of the standing injection valve of this invention in closed position.

FIGS. 13 and 14 show another form 61 of the standing injection valve of this invention utilizing an annular valve 62 to control flow between interior flow passage 61*a* and regions exterior of the valve. The standing injection valve shown in FIG. 13 has a connector 63 having an appropriate thread 63*a* for connecting the valve in a well flow conduit or a well tool string. The connector has a number of flow passages 63*b* and is connected and sealed to housing 64 with thread 65 and resilient seal 66. The housing is provided with a bore 64*a*, a shoulder 64*b*, another bore 64*c*, a number of flow slots 64*d* and a thread 64*e*. Inserted in bore 64*a* is a body 67 and a filter 68. The body is retained against shoulder 64*b* and the filter is trapped by connector 63. The body has at least one flow passage 67*a* communicating with passage 63*b* through filter 68, a counterbore 67*b*, a sealing surface 67*c*, a port 67*d* and a thread 67*e* in the counterbore. Body 67 is sealed in bore 64*a* with resilient seal 69.

Installed in counterbore 67*b* is an inlet control check valve 70 which includes a spring 70*a* and a valve ball member 70*b*. The spring is compressed by a screw 71 sealingly engaging the valve member with seal surface 67*c*.

Body 67 has at least one more flow passage 67*f* which has counterbores 67*g* and 67*h* and a seal surface 67*i*. A check valve 72 having a spring 73 and a valve ball member 74 is installed in counterbore 67*h*. The spring is compressed by filter 68 sealingly engaging valve ball member with seal surface 67*i*.

An elongate annular valve member 75 is connected in connector 63 with thread 76. The valve member has flow ports 75*a* communicating with flow passages 63*b*, through filter 68 to flow passage 67*a* and bore 67*h*. The valve member also has upper and lower seal surfaces 75*b*, a recess 75*c*, a port 75*d*, an annular sealing surface 75*e* and a bore 75*f*. The valve xember is sealed in body 67 with resilient seal 77. An orifice 78 having ports 78*a* is slidably sealed in bore 75*f* by resilient seal 79.

A piston 80 having a pressure responsive surface 80*a*, and a port 80*b* is slidably sealed in bore 64*c* by resilient seal 81 and is slidably sealed around lower seal surface 75*b* by upper and lower resilient seals 82 to form a variable volume pressure chamber 83 with annular valve member 75, body 67 and housing 64.

Threaded into thread 80*c* is a seat member 84, having a seal surface 84*a*. Valve member 75 and the seat member form annular valve 62. The seat member 84 is slidably sealed around a guide 85 with resilient seal 86. The guide is connected to housing 64 by thread 64*e*. Mounted around the guide between the lower end of the seat and a shoulder on the guide is a spring 87. Housed in a bore in the guide is a flow opened gravity closed check valve 88 having a ball valve member 89, an annular seat 90 and a cage 91. The seat is sealed in the guide bore with resilient seal 92 and retained in the bore by a retainer 93, threaded into thread 84*a*.

The annular valve form of the standing injection valve of this invention shown in FIG. 13 may be operated in a well conduit as a standing valve or an injection valve. Before installation in a well conduit, the opening pressure of control check valve 70 should be set to the desired opening pressure of annular valve 62 for injection flow. The opening pressure of valve 70 may be adjusted by turning screw 71.

The standing injection valve is then connected or installed in a well flow conduit with the producing formation in communication with annular valve 62 through flow slots 64*d* and check valve 89. Formation pressure acting spring 87 holds seat 84 sealingly engaging valve member 75 and valve 62 upwardly on piston seals 81 and 82 forces seat 84 to seal tighter on valve member 75. Formation pressure acting upwardly on valve 88 lifts ball 89 from seat 90 permitting production flow upwardly through flow passage 61*a*. If there is an orifice 78 in bore 75*f* which has an internal diameter less than passage 61*a*, production flow will be restricted. Any downward (or injected) flow through passage 61*a* toward the well formation is prevented by check valve 88.

The valve of FIG. 13 may be operated as an injection valve without removal from the well conduit by increasing pressure in flow passage 61*a* above check valve 88, sealingly engaging ball 89 on seat 90 and closing valve 88. This increased pressure acts through ports 75*a*, flow passages 63*b*, filter 68 into counterbore 67*h* on closed check valve 72. The pressure also acts through filter 68 into passage 67*d* onto valve ball 70*b* of inlet control valve 70. When passage 61*a* pressure is increased sufficiently to open control valve 70 against spring 70*a*, flow may continue through port 67*d* into recess 75*c* and into pressure chamber 83 to act on piston surface 80*a*. Pressured fluid from passage 61*a* is prevented from acting through passages 67*h*, 67*f* and 67*g* on piston surface 80*a* by closed check valve 72. Then, when pressure in chamber 83 is sufficient to move piston 80 and seat 84 downward compressing spring 87, seat 84 moves out of sealing engagement with annular valve member 75, opening valve 62, and permitting downward injection flow from passage 61*a* through orifice 78, orifice ports 78*a* and slots 64*d* to outside valve 61 and into the formation. Increased injected flow impinging on orifice 78 will move the orifice downwardly in bore 75*f* further moving seat 84 away from valve member 75, opening valve 62 and compressing spring 87, as shown in FIG. 14. Injected flow will continue until pressure is reduced sufficiently in flow passages 61*a* and 67*d* to allow spring 70*a* to close control valve 70. Compressed spring 87 now moves guide 84 and piston 80 upwardly, and as control valve 70 is closed, fluid in chamber 83 communicates through passages 67*g* and 67*f*, opening check valve 72 to permit fluid to flow through passage 67*h*, filter 68, passage 63*b*, ports 75*a* and return to passage 61*a*. Further extension of spring 87 sealingly reengages seat 84 with annular valve member 75, closing valve 62. Any pressure trapped between upper and lower seals 82 on piston 80 is vented through port 75*d* as upper seal 82 moves above port 75*d*.

Figure 15:
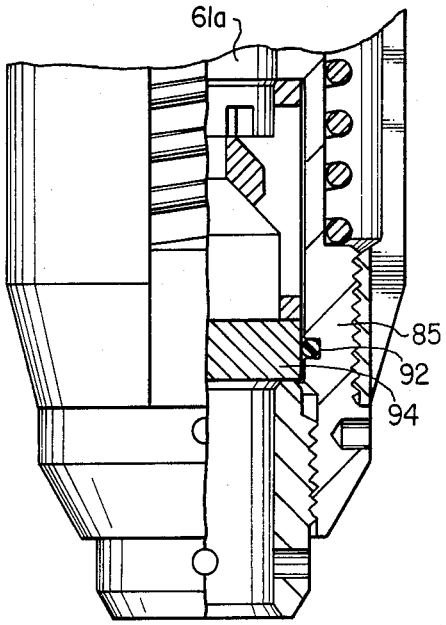
FIG. 15 is a drawing of the lower portion of the standing injection valve of FIG. 13, showing a disc installed in place of the ball check valve and seat.

Operation of the valve 61 of FIG. 13 may be limited to injection only by removing valve ball 89 and seat 90 and installing a disc 94 in place of seat 90, as shown in FIG. 15. The disc, sealed to guide 85 with resilient seal 92, prevents upward production flow from below valve 61 and passage 61*a*.

What I claim is:

1. A standing valve operable as an injection valve comprising:

(a) a housing having a longitudinal flow passage therethrough and at least one lateral flow passage through the housing wall communicating between said longitudinal flow passage and the housing exterior;

(b) annular valve means in said housing for controlling flow through said lateral passage including an annular valve member mounted within said housing and a longitudinally movable annular seat member sealingly engageable with said valve member;

(c) operator means connected to said seat member for moving said seat member between an open position, disengaging from said valve member and permitting flow between said housing passage and exterior, and a closed position, engaging wtih said valve member and preventing flow between said passage and said exterior;

(d) control means for controlling operator means pressure required to move said seat member to open position; and (e) check valve means in said housing below said annular valve means permitting upward flow and preventing downward flow through said longitudinal passage.

2. The standing valve of claim 1 wherein the check valve means comprise:

(a) a body sealed in the housing;

(b) an annular seat sealed in said body; and (c) a valve ball sealingly engageable with said seat.

3. The standing valve of claim 2 wherein the operator means comprise:

(a) annular piston means in the housing connected to the annular seat member, said piston means responsive to pressure in the longitudinal flow passage for moving the said seat member to the open position;

(b) biasing means for biasing said seat member to the closed position; and (c) a flow passage in the housing wall communicating the longitudinal flow passage with said annular piston means.

4. The standing valve of claim 3 wherein the annular piston means include:

an annular piston having upper seals, slidably sealing said piston in the housing and around the annular valve member and a lower seal, slidably sealing said piston around the check valve body, said piston having ports through said piston wall between said upper and lower seals.

5. The standing valve of claim 4 wherein the control means is a check valve in the housing wall flow passage permitting flow from the housing longitudinal passage to the annular piston and preventing flow from said annular piston to said housing flow passage.

6. The standing valve of claim 5 wherein the check valve includes adjustable means biasing said valve to prevent flow.

7. The standing valve of claim 5 wherein the control means further include additional flow passages in the housing wall and a check valve in each additional housing wall flow passage permitting flow from the annular piston to the housing longitudinal flow passage and preventing flow from said longitudinal flow passage to said annular piston.

8. The standing valve of claim 4 wherein the biasing means is a spring around the check valve body between a shoulder on the check valve body and the lower end of the seat member.

9. A standing valve operable as an injection valve comprising:

(a) a housing having a longitudinal flow passage therethrough and at least one lateral flow passage through the housing wall communicating between said longitudinal passage and the housing exterior;

(b) check valve means in said housing permitting upward flow and preventing downward flow through said longitudinal passage including a body sealed in the housing, an annular seat sealed in said body, and a valve ball sealingly engageable with said seat;

(c) annular valve means above said check valve means in said housing for controlling flow through said lateral passage including an annular valve member mounted within said housing and a longitudinally movable annular seat member sealingly engageable with said valve member;

(d) operator means connected to said seat member for moving said seat member between an open position, permitting flow between said housing passage and exterior, and a closed position, preventing flow between said passage and said exterior, including annular piston means in said housing connected to the seat member, said piston means responsive to pressure in the longitudinal flow passage for moving said seat member to the open position, said piston means having an annular piston with upper seals slidably sealing said piston in said housing and around said annular valve member and a lower seal, slidably sealing said piston around said check valve body, said piston having ports through said piston wall between said upper and lower seals and biasing means for biasing said seat member to the closed position including a spring around said check valve body between a shoulder on said body and the lower end of the seat member, and flow passages in the housing wall communicating the longitudinal flow passage with said annular piston; and (e) control means for controlling operator means pressure required to move said valve seat member to open position including a check valve having adjustable opening pressure means in one of said housing wall flow passages permitting flow from the housing longitudinal passage to the annular piston, and check valves in all other housing wall flow passages permitting flow from said annular piston to said housing longitudinal passage.

10. An injection valve comprising:

(a) a housing having a longitudinal flow passage therethrough and at least one lateral flow passage through the housing wall communicating between said longitudinal flow passage and the housing exterior;

(b) annular valve means in said housing for controlling flow through said lateral passage including an annular valve member mounted within said housing and a longitudinally moveable annular seat member sealingly engageable with said valve member;

(c) operator means connected to said seat member for moving said said seat member between an open position, disengaging from said valve member and permitting flow between said housing passage and exterior, and a closed position, engaging with said valve member and preventing flow between said passage and said exterior;

(d) control means for controlling operator means pressure required to move said seat member to open position; and (e) means in said housing below said annular valve means for preventing flow between said longitudinal passage and the housing exterior including a body sealed in said housing and a disc sealed in said body.

11. An injection valve comprising:

(a) a housing having a longitudinal flow passage therethrough and a lateral flow passage through the housing wall communicating between said longitudinal passage and the housing exterior;

(b) annular valve means in said housing for controlling flow through said lateral passage including an annular valve member mounted within said housing and a longitudinally moveable annular seat member sealingly engageable with said valve member;

(c) means in said housing below said annular valve means preventing flow into said longitudinal passage including a body sealed in said housing and a disc sealed in said body;

(d) operator means connected to said seat member for operating said annular seat member between an open position, permitting flow between said housing passage and exterior and a closed position, preventing flow between said passage and said exterior, including annular piston means in said housing responsive to pressure in the longitudinal flow passage for moving said seat member to the open position, said piston means having an annular piston with upper seals slidably sealing said piston in said housing and around said annular valve member and a lower seal, slidably sealing said piston around said body, said piston having ports through said piston wall between said upper and lower seals, biasing means for biasing said seat member to the closed position including a spring around said body between a shoulder on said body and the lower end of the seat member, and flow passages in the housing wall communicating the longitudinal flow passage with said annular piston; and (e) control means for controlling operator means pressure required to move said seat member to open position including a check valve having adjustable opening pressure means in one of said housing wall flow passages permitting flow from the housing longitudinal passage to the annular piston, and check valves in all other housing wall flow passages permitting flow from said annular piston to said housing longitudinal passage.

* * * * *